US006871467B2

(12) United States Patent
Hafner

(10) Patent No.: US 6,871,467 B2
(45) Date of Patent: Mar. 29, 2005

(54) DECKING SYSTEM WITH CLIP APPARATUS

(76) Inventor: Robert Hafner, 34202 SW. South Ranch Rd., Newberg, OR (US) 97132

( * ) Notice: Subject to any disclaimer, the term of this patent is extended or adjusted under 35 U.S.C. 154(b) by 25 days.

(21) Appl. No.: 10/603,399

(22) Filed: Jun. 24, 2003

(65) Prior Publication Data

US 2004/0045244 A1 Mar. 11, 2004

Related U.S. Application Data

(60) Provisional application No. 60/408,701, filed on Sep. 6, 2002.

(51) Int. Cl.[7] ..... E04B 5/00

(52) U.S. Cl. ..... 52/586.1; 52/489.1; 52/582.1; 52/480

(58) Field of Search ..... 52/715, 489.1, 52/586.1, 582.1, 585.1, 480; 403/388, 384, 400, 286

(56) References Cited

U.S. PATENT DOCUMENTS 4,193,230 A * 3/1980 Piana ..... 52/92.2
5,997,209 A * 12/1999 Sachs ..... 403/388
D423,325 S * 4/2000 Liss ..... D8/349
6,101,777 A * 8/2000 Bodine et al. ..... 52/506.06
6,279,286 B1 * 8/2001 Ichihashi ..... 52/489.1
6,314,699 B1 * 11/2001 West ..... 52/489.1
6,332,299 B1 * 12/2001 Stewart, III ..... 52/696
6,651,398 B2 * 11/2003 Gregori ..... 52/489.1
2003/0101673 A1 * 6/2003 West et al. ..... 52/489.1
2003/0110727 A1 * 6/2003 Gregori ..... 52/489.1

* cited by examiner

*Primary Examiner*—Naoko Slack
*Assistant Examiner*—Jennifer I. Thissell
(74) *Attorney, Agent, or Firm*—Kolisch Hartwell, P.C.

(57) ABSTRACT

A decking system and clip apparatus used therein are provided. According to one aspect of the invention, the clip apparatus typically includes a top portion and a pair of lateral projections extending from opposite sides of the top portion. Each lateral projection is configured to contact a respective decking member, thereby maintaining a pre-defined distance between the decking members. The clip apparatus further typically includes a pair of spaced-apart downward projections extending downward from the top portion, the downward projections being separated by a void sized to receive the joist.

12 Claims, 2 Drawing Sheets

DECKING SYSTEM WITH CLIP APPARATUS

CROSS-REFERENCE TO RELATED APPLICATION

This application claims priority to U.S. Provisional Patent Application Ser. No. 60/408,701, entitled DECK SECURING SYSTEM AND APPARATUS, filed Sep. 6, 2002, the entire disclosure of which is herein incorporated by reference.

TECHNICAL FIELD

The present invention relates generally to a decking system with a clip apparatus for securing a decking member to an underlying joist.

BACKGROUND OF THE INVENTION

A typical deck includes surface boards laid upon a foundation of joists. The surface boards are typically manufactured from either softwoods, such as pine and fir, or hardwoods, such as walnut or ipe. Softwoods are typically less expensive and easier to work with, while hardwoods are typically more expensive and difficult to work with, but offer superior finish, strength, and longevity. During manufacture, softwood surface boards may easily be fastened to the joists by directly nailing or screwing through the boards into the joists, since softwoods typically do not split or crack when penetrated by a nail or screw. Hardwood surface boards, however, will often split or crack if nails or screws are directly inserted therein. For this reason, hardwood surface boards are typically predrilled with thru-holes, through which screws are inserted to secure the boards to the joists, thereby avoiding cracking.

One problem with this approach is that several hundred holes must be predrilled for an average deck, which is time consuming and expensive, making hardwood decks too costly for many consumers. It would be desirable to provide a system and apparatus for attaching surface boards to underlying joists, which do not require screwing or nailing directly into the surface boards, or predrilling of the surface boards.

SUMMARY OF THE INVENTION

A decking system and clip apparatus used therein are provided. According to one aspect of the invention, the clip apparatus typically includes a top portion and a pair of lateral projections extending from opposite sides of the top portion. Each lateral projection is configured to contact a respective decking member, thereby maintaining a predefined distance between the decking members. The clip apparatus further typically includes a pair of spaced-apart downward projections extending downward from the top portion, the downward projections being separated by a void sized to receive the joist.

According to another aspect of the invention, the decking system typically includes a plurality of decking members, each decking member being spaced apart from at least one other decking member by a gap. The gap is typically bordered by side surfaces of adjacent decking members, each side surface having a notch formed therein. The decking system also typically includes at least one joist crossing under a gap between adjacent decking members. The decking system further typically includes a plurality of clip apparatuses. Each clip apparatus typically includes a top portion positioned in the gap above the joist, two lateral projections that extend from the top portion into respective notches on either side of the gap, and a pair of downward projections that extend from the top portion to respective positions adjacent opposite sides of the joist.

DETAILED DESCRIPTION OF THE INVENTION

Figure 1:
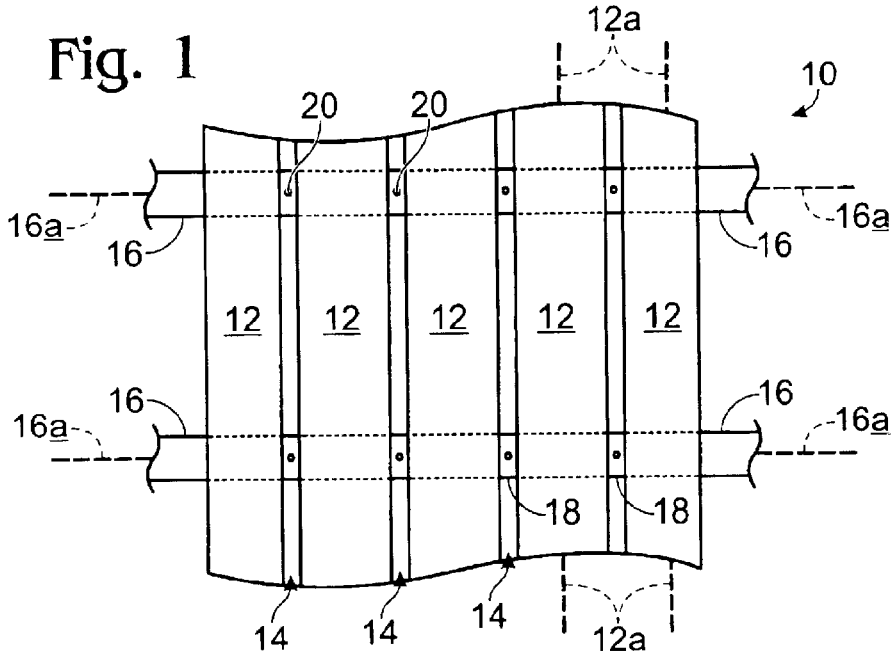
FIG. 1 is a top view of a decking system according to one embodiment of the present invention.

FIG. 1 shows generally a decking system 10 according to one embodiment of the present invention. Decking system 10 typically includes a plurality of decking members 12 spaced apart by gaps 14 and secured to a plurality of joists 16 by clips 18 and fasteners 20. Decking members 12 are typically oriented along decking member axes 12*a*, and joists 16 are typically oriented along joist axes 16*a*. Decking members 12 collectively form a walking surface of decking system 10.

Typically, the joist axes and decking member axes are substantially perpendicular, although it will be appreciated that alternatively the joists and decking members may be angled relative to each other, for example, at a 45 degree orientation. Decking members 12 are typically hardwood, although it will be appreciated that alternatively softwoods, plastics, composites, metals, or other materials may be used.

Figure 2:
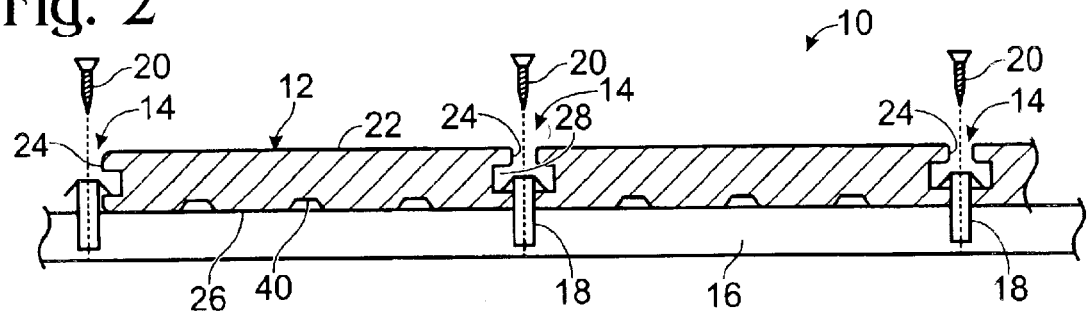
FIG. 2 is a partial cutaway side view of the decking system of FIG. 1.
Figure 3:
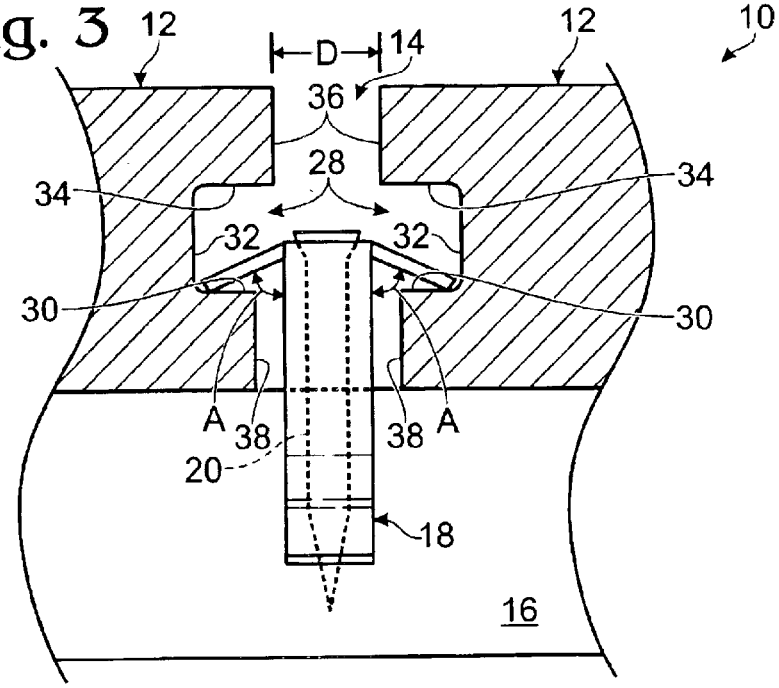
FIG. 3 is a detail view of a clip apparatus and adjacent decking members of FIG. 2.
Figure 5:
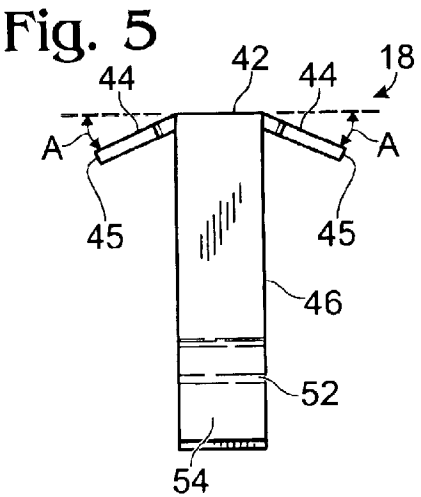
FIG. 5 is a side view of the clip apparatus of FIG. 4.
Figure 6:
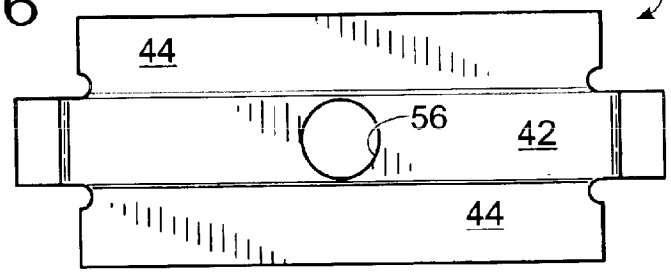
FIG. 6 is a top view of the clip apparatus of FIG. 4.
Figure 4:
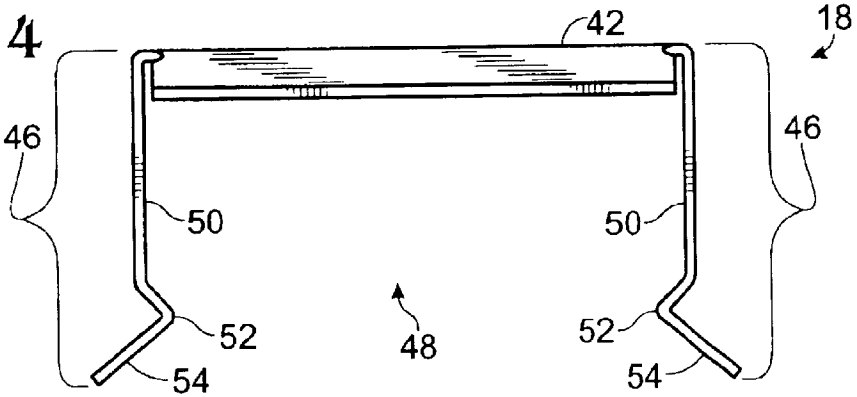
FIG. 4 is a front view of the clip apparatus of the decking system of FIG. 3.
Figure 7:
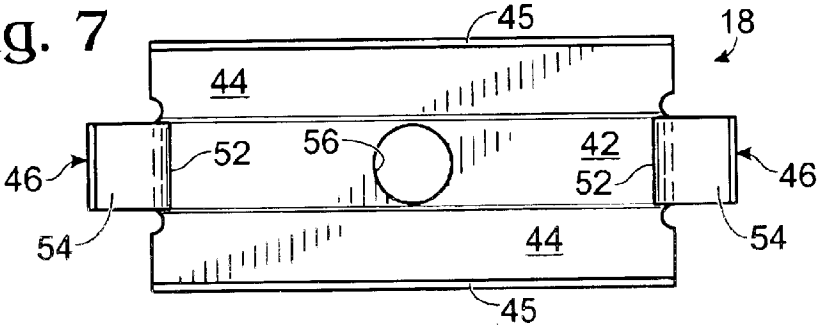
FIG. 7 is a bottom view of the clip apparatus of FIG. 4.

As shown in FIGS. 2 and 3, decking members 12 typically include a top surface 22, side surfaces 24, and a bottom surface 26. Side surfaces 24 are typically precut with side notches 28, having a lower surface 30, an inner wall 32, and an upper surface 34. Side notches 28 are typically rectangular; although a wide variety of other shapes are also possible, such as triangular, or curved. Notches 28 typically separate an upper lip 36 and a lower lip 38 on the side surface 24 of decking member 12. Typically, upper lip extends further into gap 14 than the lower lip. Bottom surface 26 is typically precut with bottom notches 40, which reduce wood-to-wood contact between the decking member and joist, and aid in drying the joists during wet weather.

As shown in FIGS. 4–7, each clip apparatus 18 typically includes a top portion 42 and a pair of lateral projections 44 extending from opposite sides of the top portion. Each lateral projection 44 is configured to contact a respective decking member 12, to maintain a predefined distance D across gap 14 between the decking members. Typically, each of the lateral projections extend laterally and downwardly at an angle A relative to top portion 42 to contact lower surface 30 and/or inner wall 32 of notch 28 of the respective decking member 12. Typically, the lateral projections extend at an angle A of between about 0 and 90 degrees, more typically between about 30 and 60 degrees, and most typically at about 45 degrees. By contacting inner walls 32, the lateral projections serve to inhibit movement of the decking members closer than distance D. Typically, the lateral projections include edges 45 that are substantially parallel to decking member axis 14*a*, when installed. The edges serve to align the decking members in a parallel orientation, when contacting inner walls 32 of notches 28.

Each of clip apparatuses 18 also includes a pair of spaced-apart downward projections 46 extending downward from top portion 42. The downward projections are separated by a void 48 sized to receive joist 16. Each of downward projections 46 typically includes an inner surface 50 that is substantially parallel to the joist axis 16*a*, when the clip is installed. The inner surfaces serve to align the clip relative to the joist. A bump 52 that extends into the void is typically positioned on each inner surface 50. Each projection typically further includes a distal end having a flared portion 54 that extends away from the void. Flared portions 54 enable the clip to be slid easily onto the joist during installation, while bumps 52 grip the joist once installed.

Top portion 42 typically includes a hole 56 adapted to receive fastener 20. The hole is typically positioned above void 48 when the clip is installed. Fastener 20 is typically inserted through hole 56, and is secured into joist 16. Typically, the fastener is a screw, and the joist is manufactured from softwood. Alternatively, the fastener may be a nail, bolt, or other suitable fastener, and joist 16 may be hardwood, plastic, composite, metal, or other suitable material. Force exerted by fastener 20 draws lateral projections 44 tightly against lower surfaces 30 of notches 28, to thereby secure the adjacent decking members 12 to the joist 16. Typically, the edges 45 of the lateral projections are substantially perpendicular to the inner surfaces 50 of the downward projections 46. Edges 45 contact inner walls 32 of notches 28, to align the clip relative to the decking members.

Typically, top portion 42, lateral projections 44 and downward projections 46 are formed in a single, integral piece of metal, although multiple pieces of metal may be joined to form these elements of clip 12. It will be appreciated that virtually any suitable manufacturing method may be used to manufacture clip 12, such as stamping, bending, drilling, etc. Preferably, the clip is manufactured from stainless steel. One type of stainless steel that has been found to work particularly well is commercially available under the designation "401 Full Hard Stainless." However, it will be appreciated that other suitable varieties of metal may also be used.

The above described embodiments do not require (but do not exclude) insertion of fasteners such as screws and nails directly into decking members, nor do they require predrilling of decking members, in order to secure the decking members to underlying joists. Thus, these embodiments avoid the undesirable cracking and costly predrilling problems associated with the prior art, and may be used to provide lower cost, higher quality decking to the consumer.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

What is claimed is:

1. A decking system, comprising:

a plurality Of decking members, each decking member being spaced apart from at least one other decking member by a gap, the gap being bordered by side surfaces of adjacent decking members, each side surface having a notch formed therein;

at least one joist crossing under the gap between adjacent decking members; and a plurality of clip apparatuses, each clip apparatus including a top portion positioned in the gap above the joist, two lateral projections that extend from the top portion into respective notches on either side of the gap, and a pair of downward projections that extend from the top portion to respective positions adjacent opposite sides of the joist.

2. The decking system of claim 1, wherein the top portion includes a hole.

3. The decking system of claim 2, further comprising a fastener extending through the hole into the joist to secure the clip apparatus and adjacent decking members to the joist.

4. The decking system of claim 1, wherein the decking members are oriented along respective substantially parallel decking member axes.

5. The decking system of claim 4, wherein the joist is oriented along a joist axis.

6. The decking system of claim 5, wherein the decking member axes are substantially perpendicular to the joist axis.

7. The decking system of claim 1, wherein the lateral projections contact a respective inner wall of each notch and inhibit movement of adjacent decking members together closer than a predetermined minimum distance.

8. The decking system of claim 1, wherein a distal end of each downward projection includes a flared portion extending away from the joist.

9. The decking system of claim 1, wherein an inner surface of each downward portion includes a bump extending toward the joist.

10. The decking system of claim 1, wherein the notch is bordered on an upper side by an upper lip and on a lower side by a lower lip, the upper lip extending further into the gap than the lower lip.

11. The decking system of claim 1, wherein the decking members are wooden.

12. The decking system of claim 1, wherein each notch is formed along substantially the entire length of respective side surface of a decking member.

* * * * *